US005203622A

United States Patent [19]

Sottile

[11] Patent Number: 5,203,622

[45] Date of Patent: Apr. 20, 1993

[54] REMOTE CONTROL LIGHTING UNIT

[76] Inventor: Keith Sottile, 2031 Marina Bay Ct., Las Vegas, Nev. 89117

[21] Appl. No.: 855,590

[22] Filed: Mar. 23, 1992

[51] Int. Cl.[5] ..... F21V 33/00

[52] U.S. Cl. ..... 362/109; 362/198; 362/253

[58] Field of Search ..... 362/109, 23, 157, 85, 362/253, 198

[56] References Cited

U.S. PATENT DOCUMENTS

| | | | |
|---|---|---|---|
| 4,893,222 | 1/1990 | Mintzer | 362/109 |
| 4,905,127 | 2/1990 | Kaminski | 362/109 |
| 4,949,230 | 8/1990 | Burmeister | 362/85 |
| 5,010,462 | 4/1991 | Mintzer | 362/109 |
| 5,034,865 | 7/1991 | Sonneman | 362/226 |
| 5,055,977 | 10/1991 | Acquanetta | 362/109 |

*Primary Examiner*—Richard R. Cole
*Attorney, Agent, or Firm*—John P. Halvonik

[57] ABSTRACT

The invention is an illuminating device for television remote control. The device has a small support base for attachment to the underside of remote control units and at least one bendable arm that is offset from the center of the remote unit. The arm supports a lighting apparatus at the top of the arm. The device may be battery powered and the bendable arm provides for a variety of positions for the lighting means.

4 Claims, 2 Drawing Sheets

REMOTE CONTROL LIGHTING UNIT

BACKGROUND OF THE INVENTION

1. Field of the Invention

The invention relates to the field of remote control apparatus and, in particular, to a source of illumination that may be attached to the remote control unit. At least one bendable arm supports the lighting source in a plurality of positions without interfering with the IR light being emitted at the front of the remote control unit.

2. Description of the Prior Art

While there are bendable arms known in the prior art, none that applicant is aware of use a bendable support arm(s) to support an illuminating means for a remote control unit. The use of such an arm offset from the centerline of the remote unit allows the support arm to hold the light over the remote unit without interfering with the beam of IR light being emitted at the front of the unit.

SUMMARY OF THE INVENTION

The invention is lighting device for illuminating the top portion of a remote control unit when the television room is dark. The lighting device has a relatively small base so that it may be attached to the underside of the remote unit. At least one bendable arm supports a lighting means from a point above the top surface of the remote unit. Usually, the arm would protrude out from under the front of the remote unit and is attached to a point that is offset from the centerline of the remote unit so that the arm(s) do not interfere with the IR light being emitted from the front of the remote unit.

It is an object of the invention to provide a flexible support arm for the lighting source of a remote control unit.

Another object of the invention is to provide a supporting means for a source of illumination for a remote control unit that will not interfere with the IR light being emitted at the front of the remote control unit.

Yet another objective is to provide a double necked support shaft for a remote control illuminating means so that the illuminating means may be supported at both sides without interfering with the IR light being emitted by the remote unit.

Another objective is to provide a flexible support arm for a remote control unit that may be placed in a number of positions.

Other objectives of the invention will become apparent to those skilled in the art once the invention has been shown and described.

DESCRIPTION OF THE PREFERRED EMBODIMENT

The apparatus is a lighting device for illuminating the top surface of remote control unit. The device finds usage when the television room is not well lit, for instance: at night. The top surface of the remote has a set of controls on it and it is helpful to be able to see these. The device is, preferably, battery powered and may come with a push button or push lever device to illuminate the remote control unit as needed.

Figure 3:
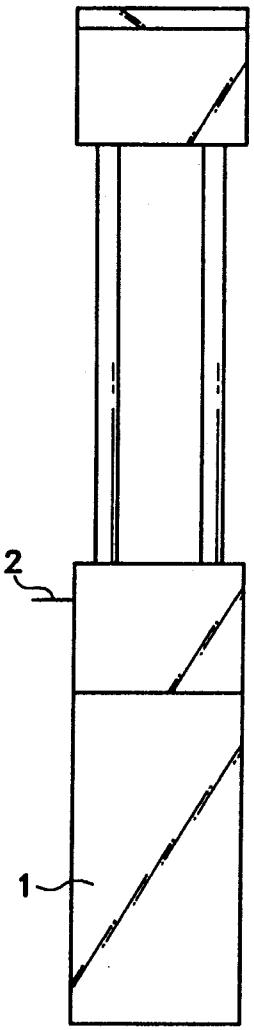
FIG. 3 shows the back of the apparatus.
Figure 2:
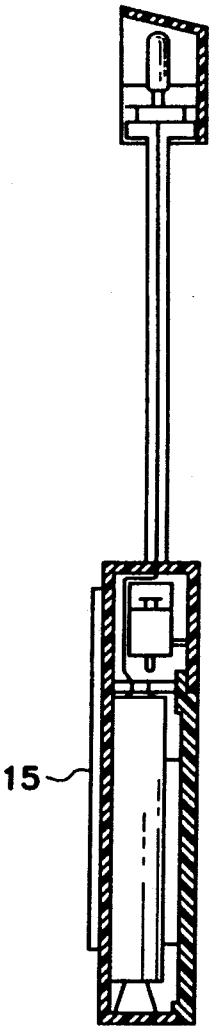
FIG. 2 shows the side view of the apparatus.
Figure 1:
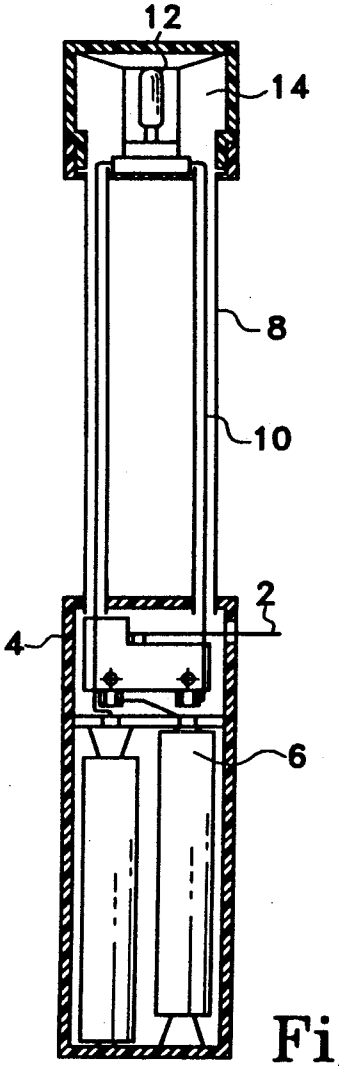
FIG. 1 shows front view of the apparatus.
Figure 4:
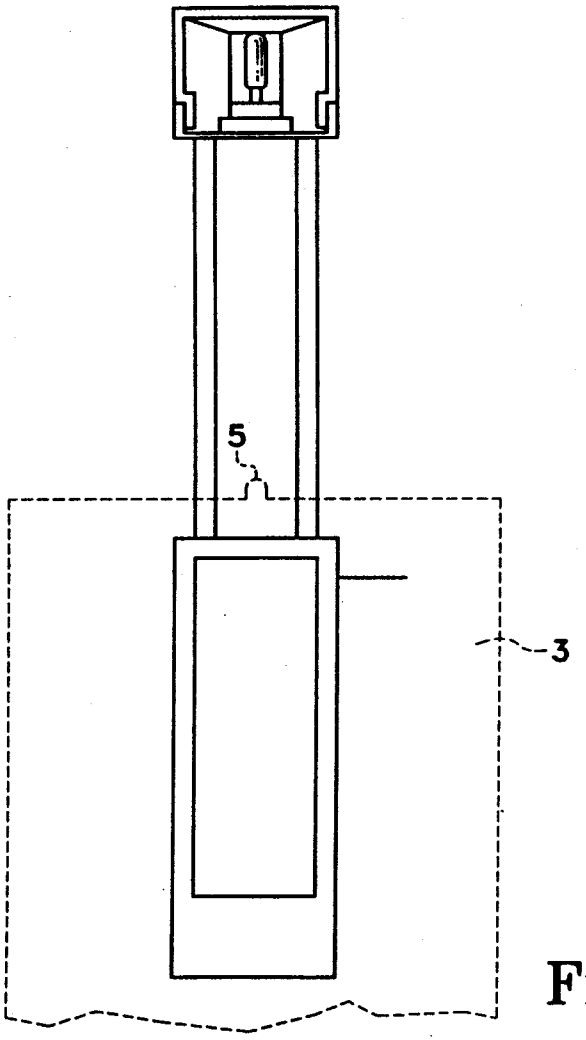
FIG. 4 shows device as attached to a remote control unit.

The device has a small base 1 preferably about 2½" by 1" so that it may be attached to the underside of the relatively small remote control unit, see FIG. 1 (remote control unit pictured as 3 in FIG. 4). Any sort of attaching means may be used to attach the support base to the underside of the remote unit. Double sided adhesive tape 15 being preferred. The support base should contain battery(s) 6 for powering the lighting source. It is thought that triple A sized batteries would be preferred in view of the small size of the support base.

Figure 5:
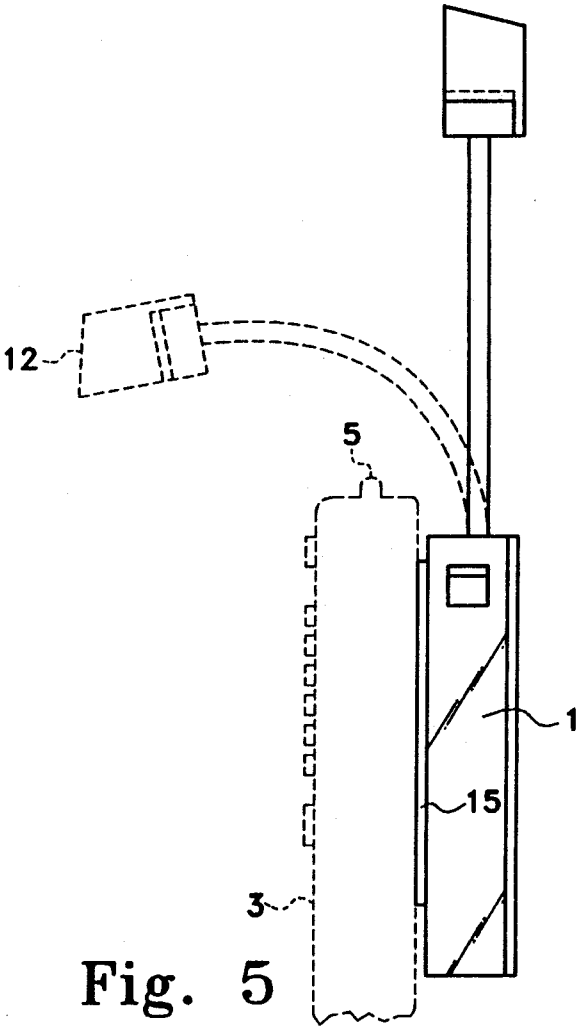
FIG. 5 shows side view of the device as attached.

Bendable support arm(s) 8 are in connection with the front of the support base and should protrude out from under the front of the remote control unit, see FIG. 5. At least one support arm is needed and any support arms that are used must be offset from the centerline of the remote unit so as not to interfere with the IR light being emitted from the front of the remote unit. If two arms are used, as shown in FIGS. 1 and 5 they should both be offset from the centerline of the remote and preferably are each on one side of the centerline as shown.

The support arms support the illuminating means 12 which is, preferably, powered by batteries stored in the support base.

Preferably there would be two support arms, one on either side of the illuminating means so that the support arm will not interfere with the infrared (IR) light being emitted from the front of the remote control unit, see FIG. 4.

It is preferred that the bendable support arm for the lighting means should be made of a ribbed rubber with a wire inside it for support. Other supports could also be used provided that they are able to be bent into a conformation that will allow the light source to illuminate the top of the remote unit. The arms should also be able to be shaped into different conformations. The wire 10 from the batteries to the lighting source may also run through the bendable arm as well as the support wires. As the arm is bendable, it can be shaped into different positions to illuminate the remote properly. It is also possible that the wire which serves as the support wire may also be used as the conducting wire.

The lighting source at the top of the support arms may be of any type, such as incandescent bulb, fluorescent bulb, halogen, etc. It is preferred that a minibulb be used in conjunction with a reflector behind it to properly illuminate the remote. It is preferred that the switch 2 for the lighting means be of a push button type, that is, it only powers the light when it is pushed on, when it is released the light goes off. This should save on the life of the batteries. Of course, other switches may be used for activating the light without varying from the spirit of the invention.

I claim:

1. An illuminated remote control unit comprising: a flat, planar support base having a top surface, an undersurface, a front edge, a back edge and a centerline starting at said front edge and running to said back edge, a bendable support arm in connection with said front edge and extending above said top surface, said arm offset to one side of said centerline, an infrared (IR) emitting device in connection with said top surface and having a front portion having an IR emitter located about near a center of said front portion and in line with said centerline, illuminating means in connection with said support arm for illuminating said IR emitting device, battery-powered electrical source in connection with said illumination means.

2. The apparatus of claim 1 having a second bendable support arm in connection with said undersurface of said support base and extending above said top surface, said second support arm offset to an opposite side of said centerline.

3. The apparatus of claim 2 wherein said bendable arms are made of thermoplastic material and having a support wire inside said thermoplastic material.

4. The apparatus of claim 3 wherein said battery powered electrical source comprises a pair of triple A batteries.

* * * * *